US006910574B2

(12) United States Patent
Straka

(10) Patent No.: US 6,910,574 B2
(45) Date of Patent: Jun. 28, 2005

(54) PORTABLE, KNOCKDOWN TACK BOX WITH SADDLE RACK(S)

(75) Inventor: John R. Straka, Fairview Park, OH (US)

(73) Assignee: John Straka, Fairview Park, OH (US)

( * ) Notice: Subject to any disclaimer, the term of this patent is extended or adjusted under 35 U.S.C. 154(b) by 202 days.

(21) Appl. No.: 10/397,004

(22) Filed: Mar. 25, 2003

(65) Prior Publication Data

US 2003/0183600 A1 Oct. 2, 2003

Related U.S. Application Data

(60) Provisional application No. 60/367,541, filed on Mar. 26, 2002.

(51) Int. Cl.[7] ..... B65D 6/00; B65D 85/00

(52) U.S. Cl. ..... 206/315.1; 206/527; 206/579; 220/4.28; 220/4.29

(58) Field of Search ..... 206/315.1, 579, 206/525–527; 211/85.11; 217/12 R, 13–16; 220/4.28–4.34, 6, 7

(56) References Cited

U.S. PATENT DOCUMENTS 234,450 A * 11/1880 Yaxley ..... 217/16
2,809,755 A * 10/1957 Martorello ..... 211/85.11
3,727,785 A * 4/1973 Lutz ..... 217/12 R
3,760,970 A * 9/1973 Lutz ..... 220/4.28
3,780,971 A 12/1973 De Fillips
3,811,574 A * 5/1974 O'Brien ..... 211/85.11
4,048,959 A * 9/1977 Steele ..... 119/512
4,432,459 A 2/1984 Coldren
4,542,832 A 9/1985 Minick et al.
4,735,331 A * 4/1988 Keenan et al. ..... 220/6
4,958,594 A 9/1990 Swagerty
5,139,155 A 8/1992 Laxson
5,191,989 A * 3/1993 Butler ..... 220/4.34
5,259,521 A 11/1993 Shaffer et al.
D343,031 S 1/1994 McElhaney
5,338,049 A * 8/1994 Goring ..... 280/47.19
5,362,078 A * 11/1994 Paton ..... 280/47.18
D377,548 S 1/1997 O'Shea
5,615,783 A 4/1997 Warnken
5,791,668 A 8/1998 Lenardson
6,533,122 B1 * 3/2003 Plunkett ..... 206/600
2001/0047970 A1 12/2001 McBride

* cited by examiner

*Primary Examiner*—Jim Foster
(74) *Attorney, Agent, or Firm*—Tucker Ellis & West LLP

(57) ABSTRACT

A tack box for storing objects by a person engaged in equestrian activities. The tack box has multiple detachable walls and at least one removable saddle rack mounted on one of the walls. The container may be broken down into multiple pieces for ease of transportation. The front of the tack box opens via two doors and a flip top panel on the lid to gain maximum access to the contents of the box.

14 Claims, 15 Drawing Sheets

PORTABLE, KNOCKDOWN TACK BOX WITH SADDLE RACK(S)

CROSS-REFERENCE TO RELATED APPLICATIONS.

This application claims the benefit of U.S. Provisional Application No. 60/367,541, filed Mar. 26, 2002.

BACKGROUND

1. Field of Invention

This invention relates to tack boxes, which are used for the storage and safeguarding of saddles, bridles, grooming implements and other related gear by persons engaged in equestrian activities.

2. Background—Discussion of Prior Art

Currently, commercially available tack boxes, trunks, chests or lockers primarily consist of rectangular, box-like structures each with a single hinged lid or door. These structures are meant to be one-piece and are not capable of being collapsed or broken down into smaller segments, which would facilitate transporting them or storing them when not in use. With rare exception, most tack boxes that are currently marketed, as evidenced by a review of multiple equestrian-related periodicals and catalogs, do not contain saddle racks and, in any event, are not made large enough to comfortably hold even a single standard-sized Western-style saddle, which is larger than its English-style counterpart.

Within the United States, the majority of participants in recreational equestrian activities are women, reportedly as high as 80% of all participants and numbering in the millions. Additionally, a good percentage of these participants own or, in other cases, lease horses and board said horses at public or private stables owned by third parties. It is common, in such circumstances, for the boarder to keep what tack she owns at the stable facility, conveniently near her horse(s). The quality and extent of amenities available for the protection and security of such boarder-owned tack likely varies widely from facility to facility, and many boarders choose to augment that protection by use of lockable tack boxes. In such circumstances, tack boxes keep an owner's gear, including her saddle, protected from airborne dirt and dust, which are always kicked up in and around stable areas; from damage by rodents; and from unauthorized borrowing or theft.

Most commercially available tack boxes fall short in one way or another in terms of the typical boarder's needs or financial capacity. Most are not large enough to hold a full complement of gear and a Western-style saddle, or they don't have a saddle rack to properly support the saddle or, in the rare case where a saddle rack is included, the tack boxes are overbuilt, expensive and targeted toward the equestrian professional. As a result, many boarders make do with homemade wooden fixtures. And because few horse people, to the extent this group reflects the characteristics of the general population, are experienced in, or inclined to do woodworking, many boarders must rely on relatives or friends to help them design and build functional tack boxes.

Another need that warrants consideration in this area is portability. Intuitively, there will be many occasions when a horse boarder will want to relocate her horse(s) and gear from one stable to another. She may become unhappy with a change in circumstances at her existing stable location, or she may find a more attractive place to board, or she herself may relocate and want to find a new stable for her horse(s) nearer her new home. In any event, tack boxes currently on the market that are large enough to comfortably accommodate and protect both saddle and gear will be too heavy and bulky for one person to move, and at least a small truck or trailer would be needed to do the job.

SUMMARY

The invention is an improved tack box. The improved tack box is a box-like container for storing objects used by a person engaged in equestrian activities, comprising multiple detachable walls and at least one saddle rack mounted on one of the walls, wherein said container may be broken down into multiple pieces for ease of transporting said container or to facilitate storage of said container when not being used by said persons for its primary purpose of storing objects used in equestrian activities. The improved tack box incorporates in one package several features that the market would likely find highly useful, at least two of which are not available in the construction of any currently marketed tack box. Those two features are (1) the ability to knock down this relatively large tack box into several, easy-to-transport segments, and (2) greater access to the internal storage area, with a front panel that opens completely via two doors and a flip-up top panel, which when used together enable a user to step part way into the tack box to gain leverage in the handling of heavy and awkward gear, such as a Western-style saddle. These features are provided in a structure that can be completely closed up, secured and locked, and which is large enough to hold a typical horse boarder's full complement of gear, including one or even two saddles, each adequately supported by a detachable saddle rack. Moreover, the invention can be constructed in a straightforward, economical manner from readily available materials, in order to provide a reasonably priced and highly functional product to a significant yet, apparently, neglected target market.

DESCRIPTION OF RENDERINGS

Figure 1:
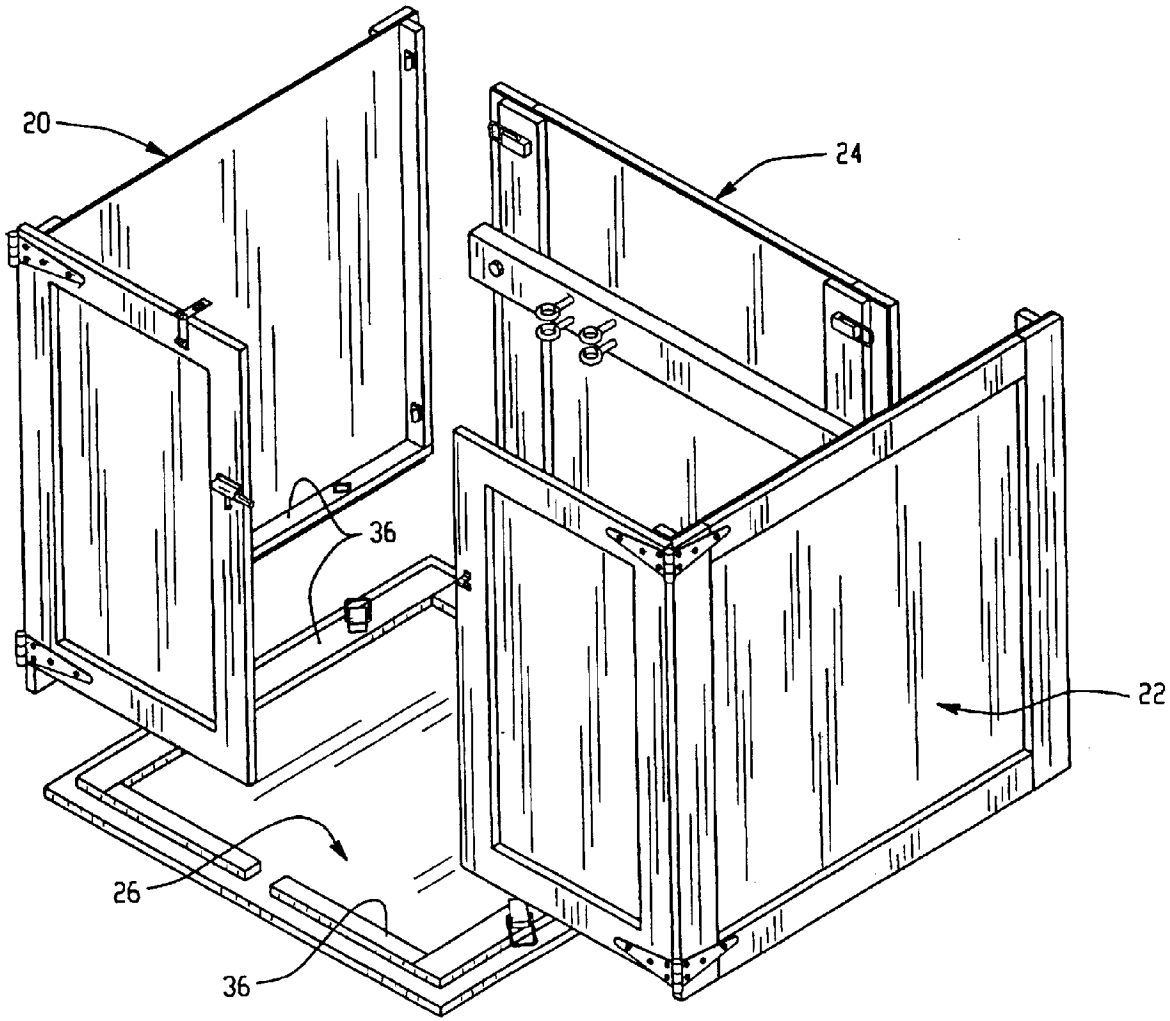
FIG. 1 is a perspective front-side view of a tack box, constructed in accordance with the invention, showing the following components before assembly: a base, a left-side wall with door attached, a right-side wall with door attached, a rear wall with an attached brace to support a removable saddle rack.

| Reference Numerals: | |
|---|---|
| 20 | Left-side wall |
| 22 | Right-side wall |
| 24 | Rear wall |
| 25 | Base |
| 28 | Hinged lid |
| 30 | Brace |
| 32 | Saddle rack |
| 34a | Door (left-side wall) |
| 34b | Door (right-side wall) |
| 36 | Raised frame |
| 40 | Metal draw latch |
| 42 | Strike |
| 44 | Piano hinge |

DESCRIPTION OF INVENTION

FIG. 1 is a perspective front-side view of a tack box, constructed in accordance with the invention. A raised frame 36 is permanently mounted on the inward surface, near the perimeter, of each of: a left-side wall 20, a right-side wall 22, a rear wall 24 and a base 26.

Figure 2:
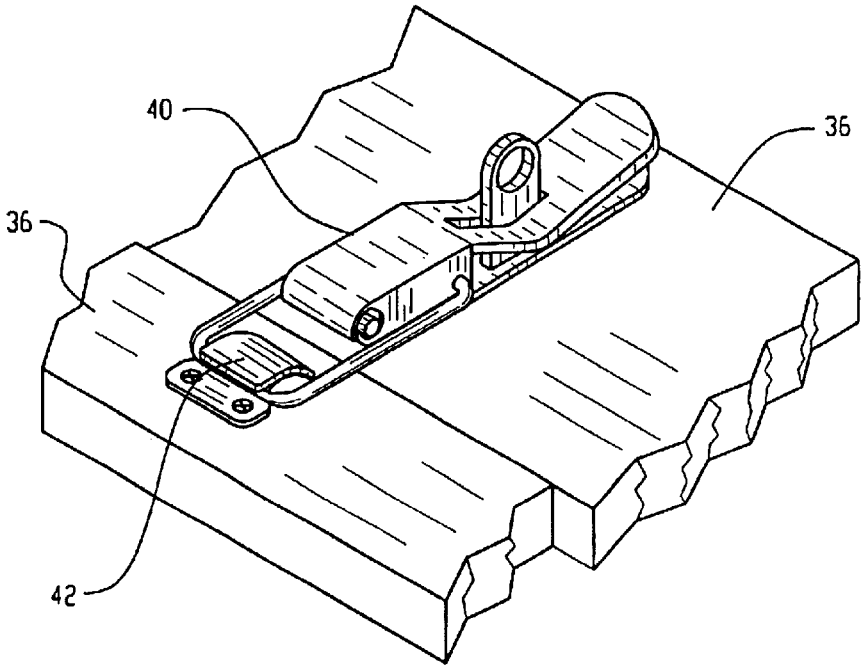
FIG. 2 is a close-up perspective, from above, of a metal draw latch with a strike.

FIG. 2 is a close-up perspective, from above, of a metal draw latch 40 and a strike 42.

Figure 3:
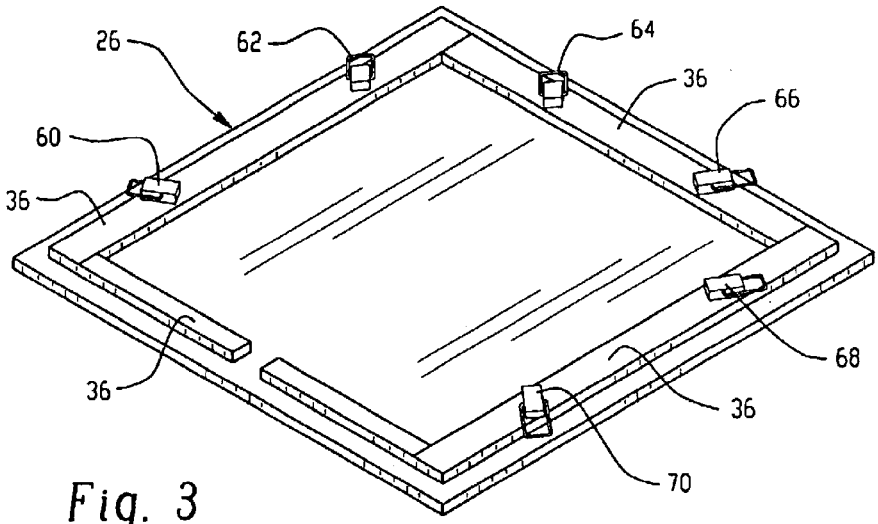
FIG. 3 is a perspective, from above, of the base of the tack box of FIG. 1.

FIG. 3 is a perspective of the base 26 from in front and above, with metal draw latches 40 mounted on the raised frame 36 of said base 26 at 60, 62, 64, 66, 68 and 70.

Figure 4:
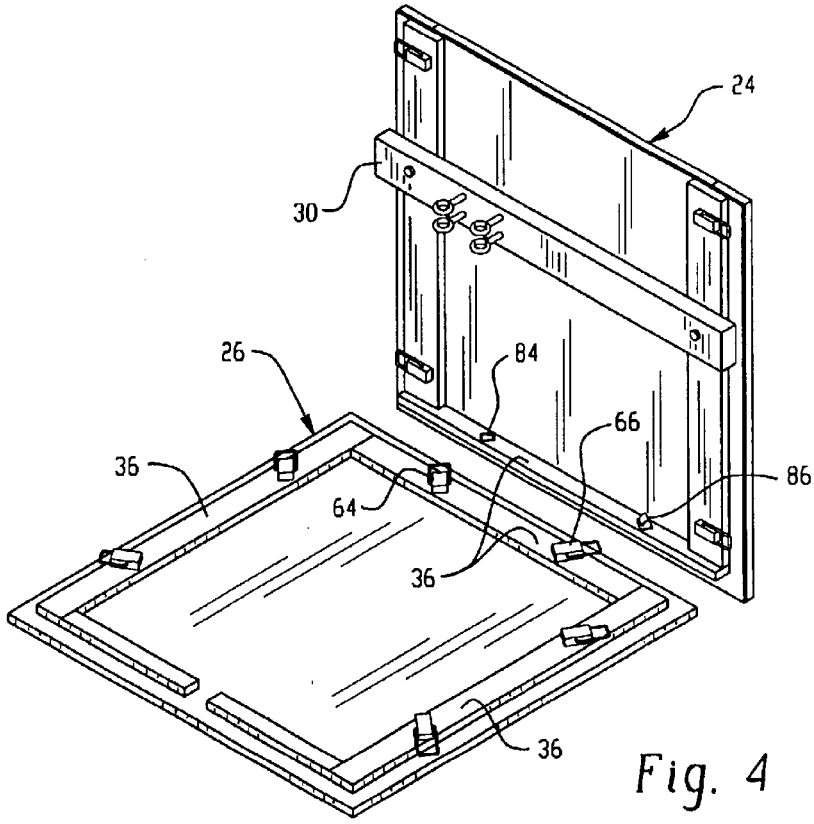
FIG. 4 is a perspective, from above, of the base and the rear wall of the tack box of FIG. 1, where said base and said rear wall are to be fastened together by metal draw latches and strikes.

FIG. 4 is a perspective of the base 26 and the rear wall 24 with a brace 30, from in front and above, with metal draw latches 40 attached to the raised frame 36 of said base 26 at 64 and 66, opposite strikes 42 on the raised frame 36 of said rear wall 24 at 84 and 86. The bottom of the raised frame 36 on said rear wall 24 rests on the edge of said base 26 and abuts the raised frame 36 of said base 26. When said rear wall 24 is so positioned on said base 26, said metal draw latches 40 at 64 and 66 are secured to said strikes 42 at 84 and 86, respectively.

Figure 5:
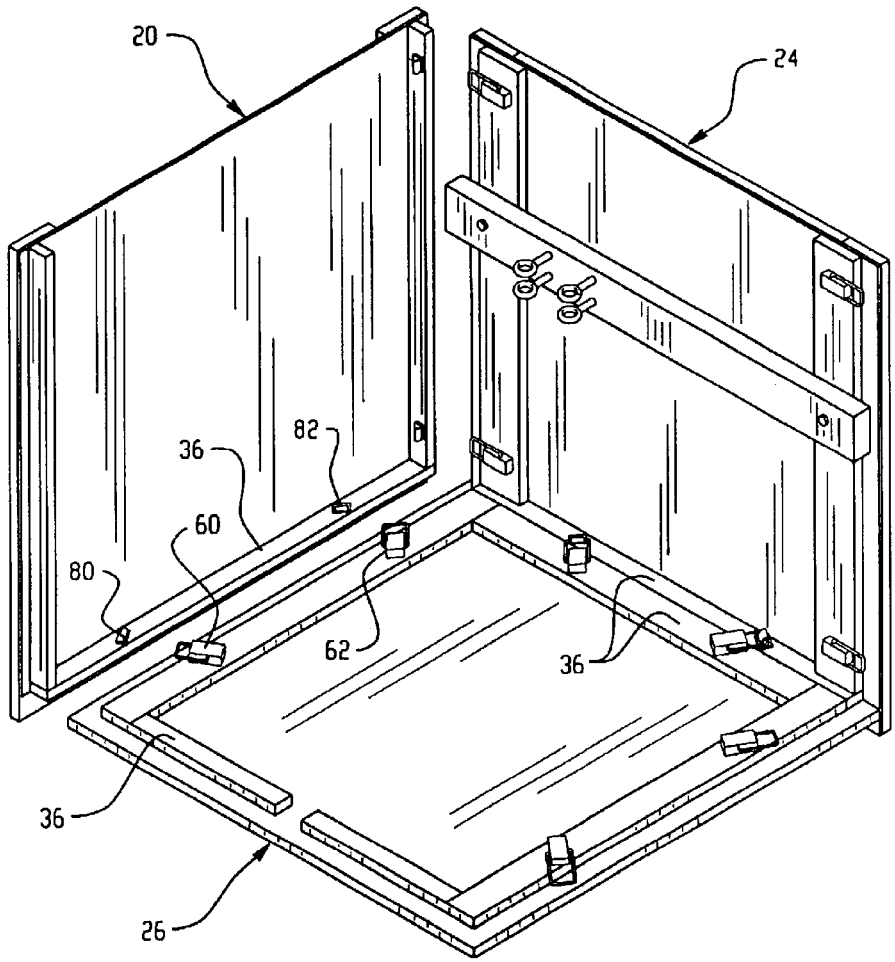
FIG. 5 is a perspective, from above, of the base and the left-side wall of the tack box of FIG. 1, where said base and said left-side wall are to be fastened together by metal draw latches and strikes.

FIG. 5 is a perspective of the base 26 and the inward surface of the left-side wall 20, from in front and above, with metal draw latches 40 attached to the raised frame 36 of said base 26 at 60 and 62, opposite strikes 42 on the raised frame 36 of said left-side wall 20 at 80 and 82. The bottom of the raised frame 36 on said left-side wall 20 is made to rest on top of the left-edge edge of said base 26 and abut the raised frame 36 of said base 26. When said left-side wall 20 is so positioned on said base 26, said metal draw latches 40 at 60 and 62 are secured to said strikes 42 at 80 and 82, respectively.

Figure 6:
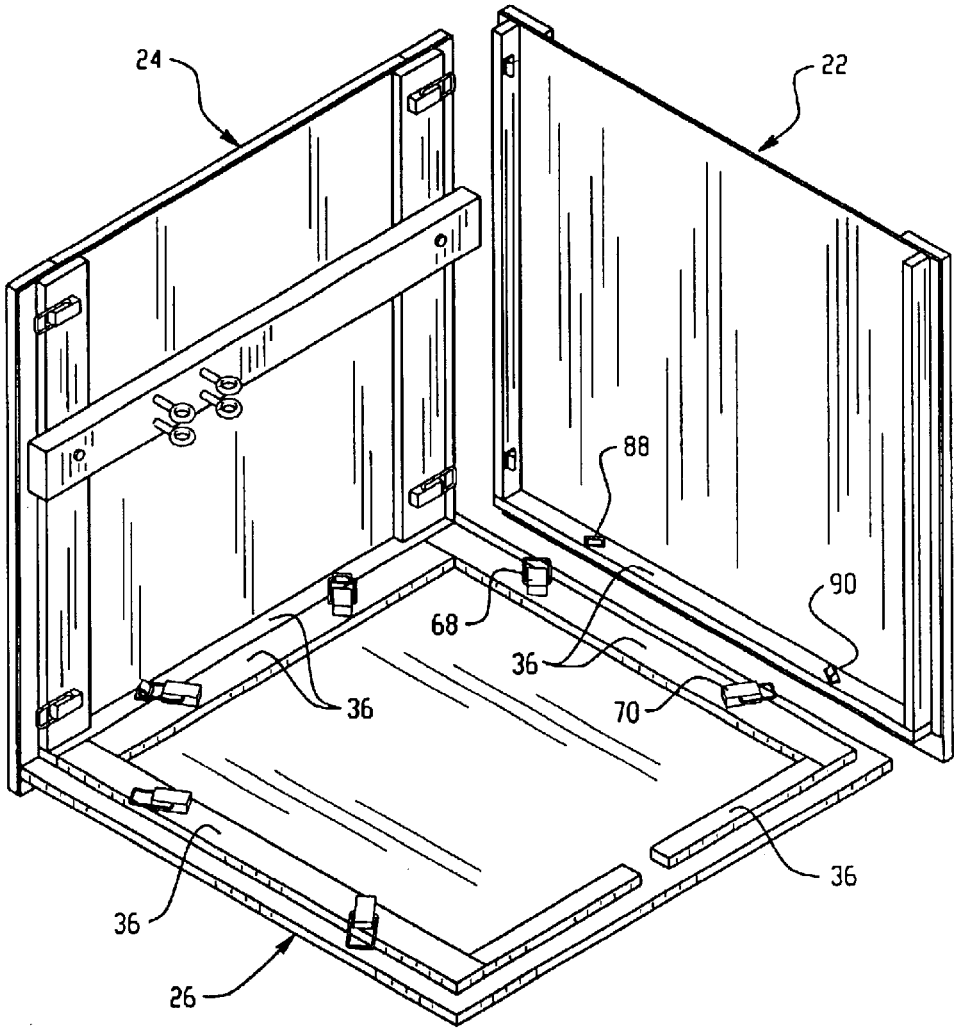
FIG. 6 is a perspective, from above, of the base and the right-side wall of the tack box of FIG. 1, where said base and said right-side wall are to be fastened together by metal draw latches and strikes.

FIG. 6 is a perspective of the base 26 and the inward surface of the right-side wall 22, from in front and above, with metal draw latches 40 attached to the raised frame 36 of said base 26 at 68 and 70, opposite strikes 42 on the raised frame 36 of said right-side wall 22 at 88 and 90. The bottom of the raised frame 36 on said right-side wall 22 is made to rest on top of the right-edge edge of said base 26 and abut the raised frame 36 of said base 26. When said right-side wall 22 is so positioned on said base 26, said metal draw latches 40 at 68 and 70 are secured to said strikes 42 at 88 and 90, respectively.

Figure 7:
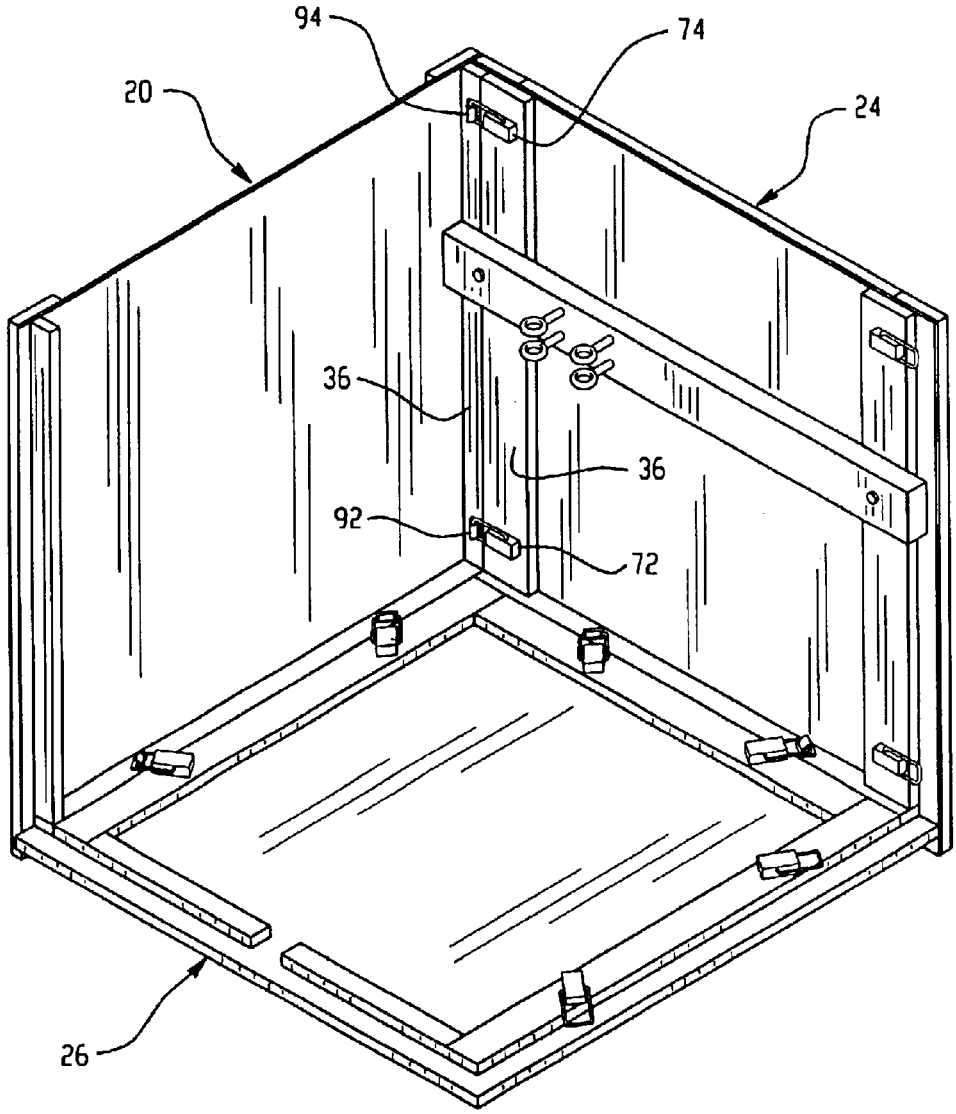
FIG. 7 is a perspective, from the front-right and above, of the base, the left-side wall and the rear wall of the tack box of FIG. 1, where said base, said left-side wall and said rear wall are fastened together by metal draw latches and strikes.

FIG. 7 is a perspective of the base 26, the left-side wall 20 and the rear wall 24, from the front-right and above, with metal draw latches 40 attached to the raised frame 36 of said rear wall 24 at 72 and 74, opposite strikes 42 on the raised frame 36 of said left-side wall 20 at 92 and 94.

Figure 8:
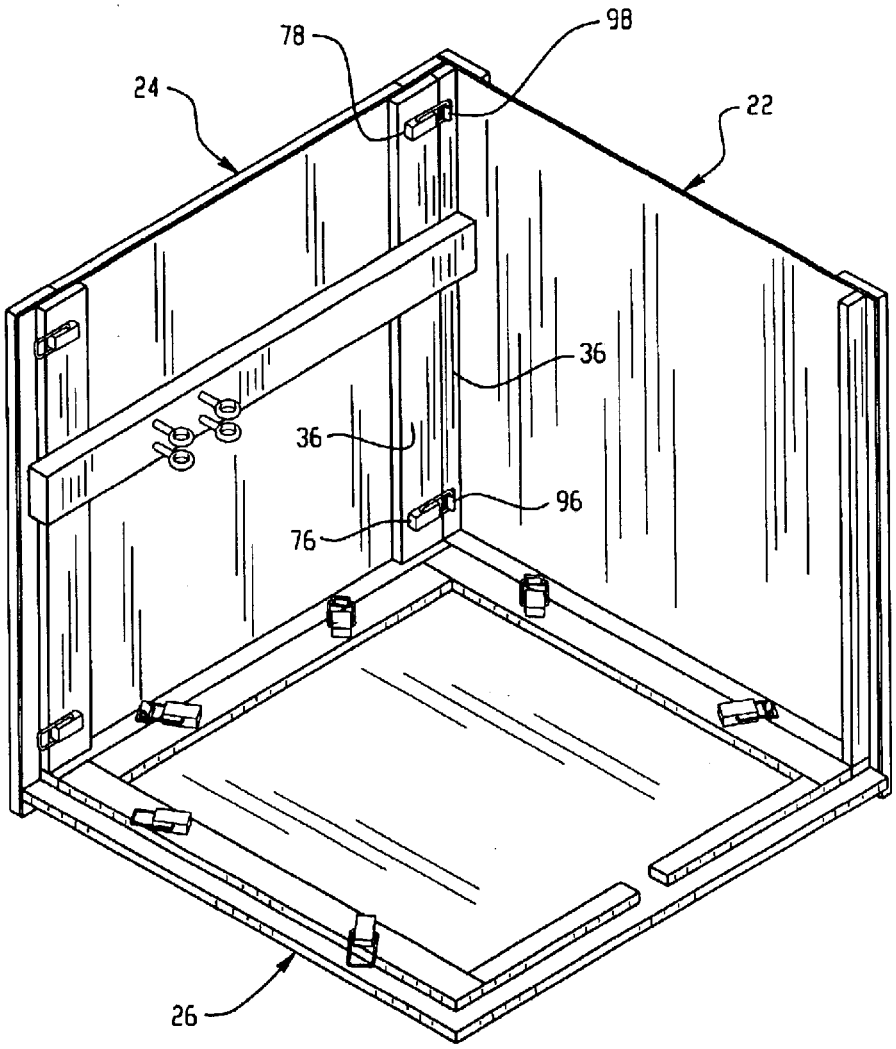
FIG. 8 is a perspective, from the front-left and above, of the base, the right-side wall and the rear wall of the tack box of FIG. 1, where said base, said right-side wall and said rear wall are fastened together by metal draw latches and strikes.

FIG. 8 is a perspective of the base 26, the right-side wall 22 and the rear wall 24, from the front-left and above, with metal draw latches 40 attached to the raised frame 36 of said rear wall 24 at 76 and 78, opposite strikes 42 on the raised frame 36 of said right-side wall 22 at 96 and 98.

Figure 9:
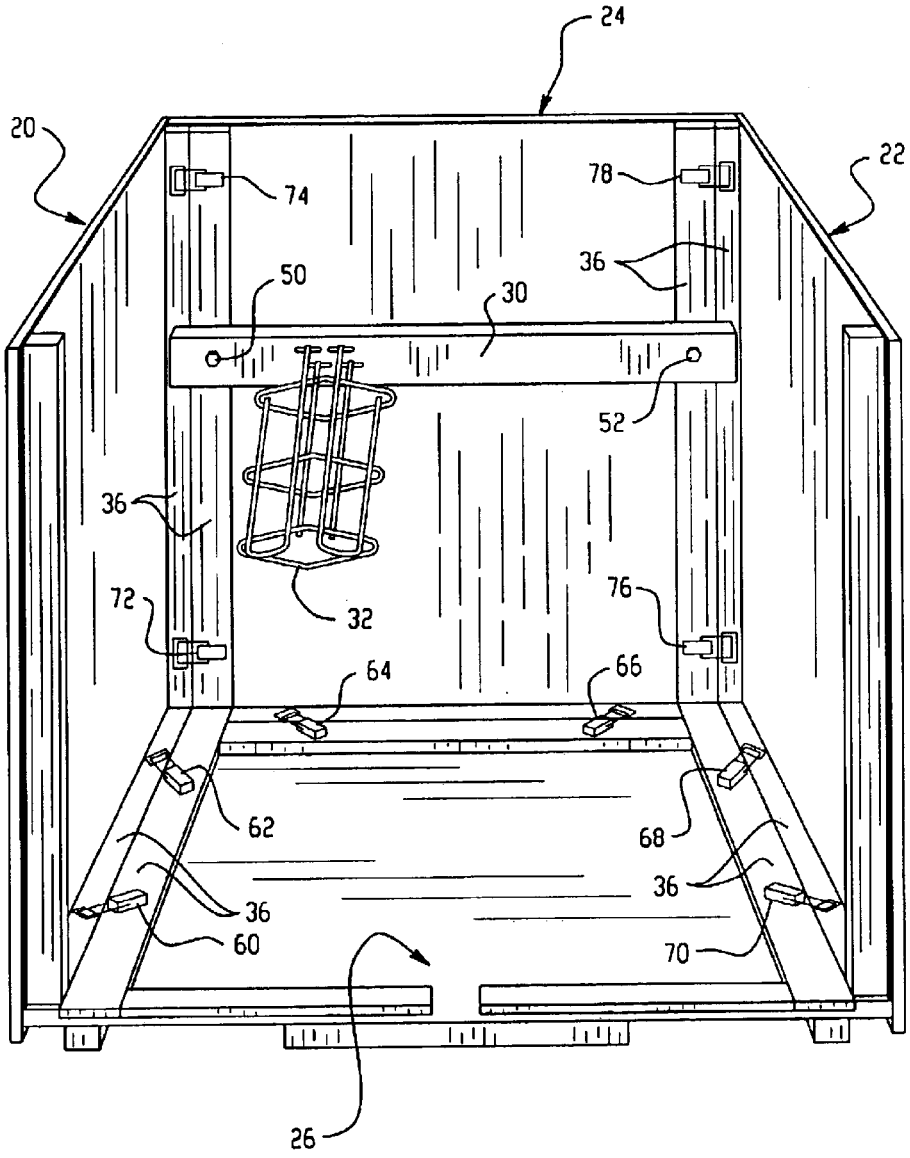
FIG. 9 is a perspective of the partially-assembled tack box, from in front and above, with the left-side wall, the right-side wall, the rear wall and the base all joined together with metal draw latches secured to strikes and the removable saddle rack resting on the brace, which is attached to said rear wall.

FIG. 9 is a perspective of the partially-assembled tack box, from in front and above, with the left-side wall 20, the right-side wall 22, the rear wall 24 and the base 26 all joined together with metal draw latches 40 secured to strikes 42 at 60, 62, 64, 66, 68, 70, 72, 74, 76 and 78. The removable saddle rack 32 rests on the brace 30, which is mounted to the raised frame 36 of said rear wall 24 at 50 and 52.

Figure 10:
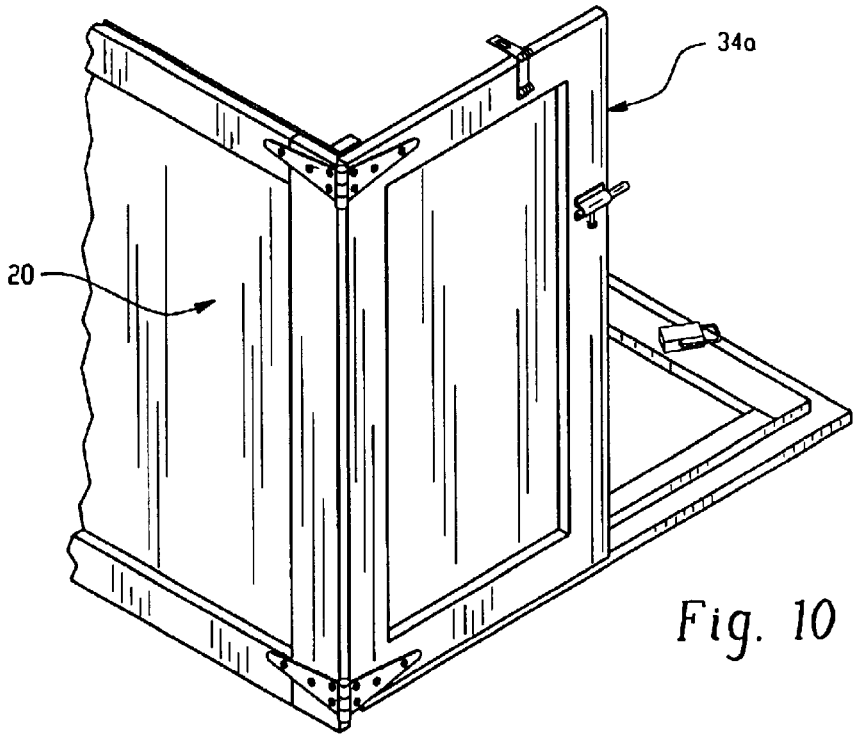
FIG. 10 is a perspective of the tack box of FIG. 1, from the front-left, of the left-side wall with door attached.

FIG. 10 is a perspective of the partially assembled tack box, from the front-left, with a door 34*a* permanently attached to the left-side wall 20.

Figure 11:
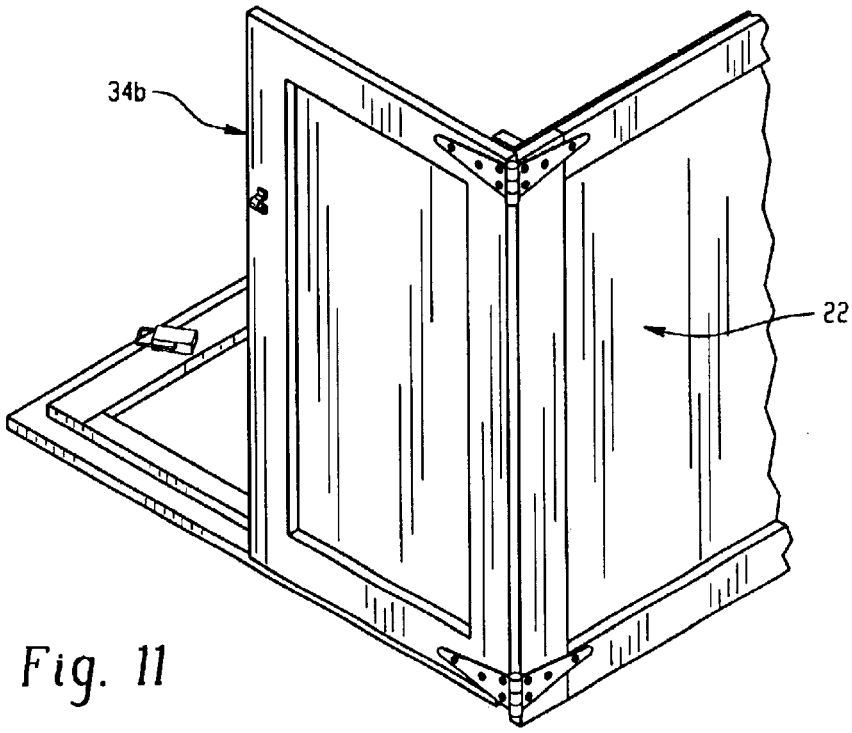
FIG. 11 is a perspective of the tack box of FIG. 1, from the front-right, of the right-side wall with door attached.

FIG. 11 is a perspective of the partially assembled tack box, from the front-right, with a door 34*b* permanently attached to the right-side wall 22.

Figure 12:
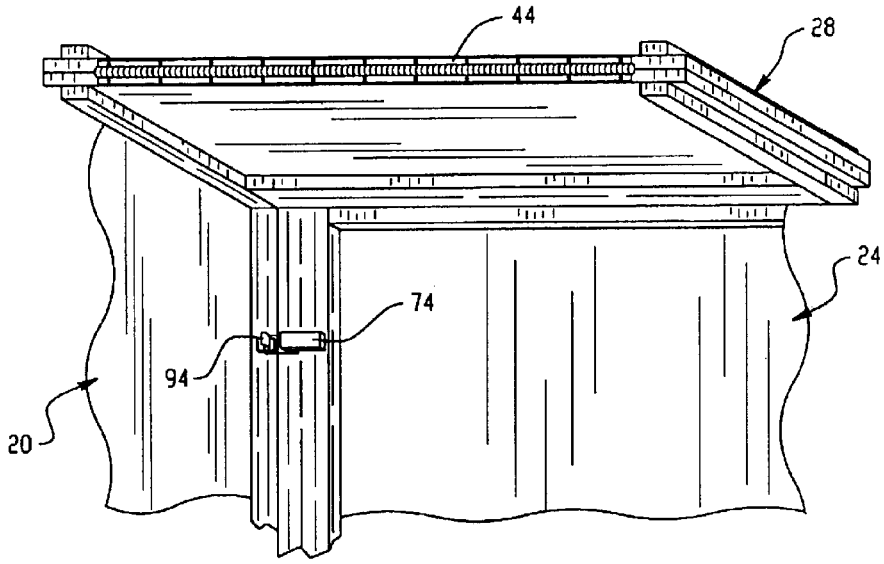
FIG. 12 is a perspective of the tack box of FIG. 1, from the front and below, of the underside of the hinged lid, the top of the inward side of the left-side wall and the top of the inward side of the rear wall.
Figure 13:
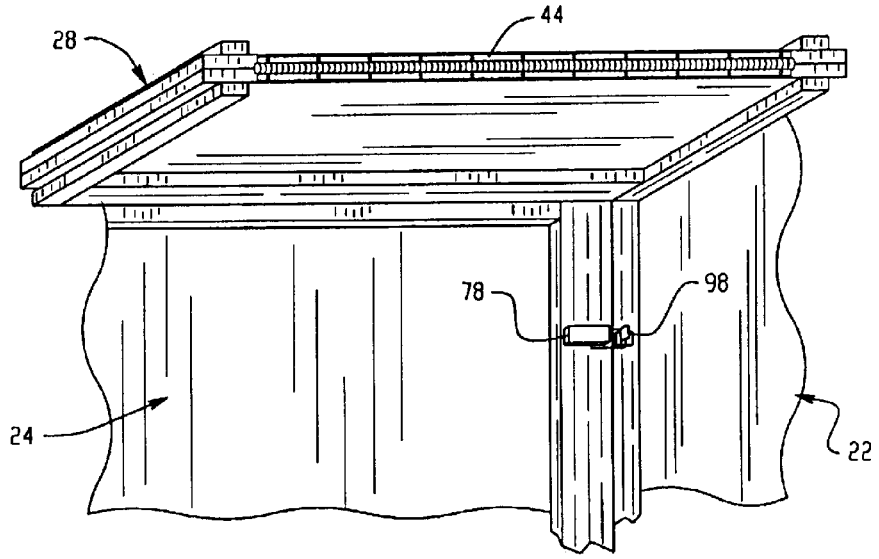
FIG. 13 is a perspective of the tack box of FIG. 1, from the front and below, of the underside of the hinged lid, the top of the inward side of the right-side wall and the top of the inward side of the rear wall.

FIGS. 12 and 13 are similar perspectives of the tack box, from in front, looking up at the rear half of the underside of the hinged lid 28, resting on the top edges of: the left-side wall 20, the right-side wall 22 and the rear wall 24. Said hinged lid 28 is in two sections, a front half and a rear half, joined together by a piano hinge 44.

Figure 17:
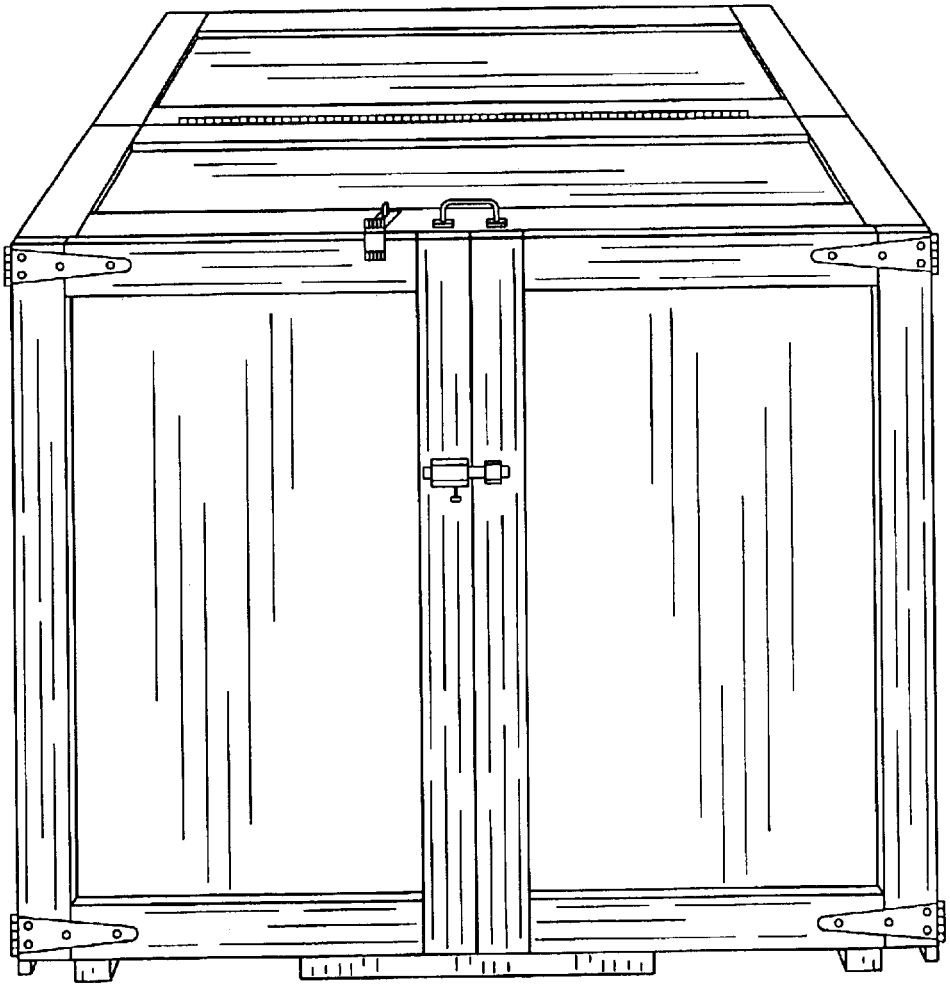
FIG. 17 is a perspective of the fully-assembled tack box of FIG. 1, from in front, with the door of the left-side wall, the door of the right-side wall and the hinged lid all in closed positions.
Figure 18:
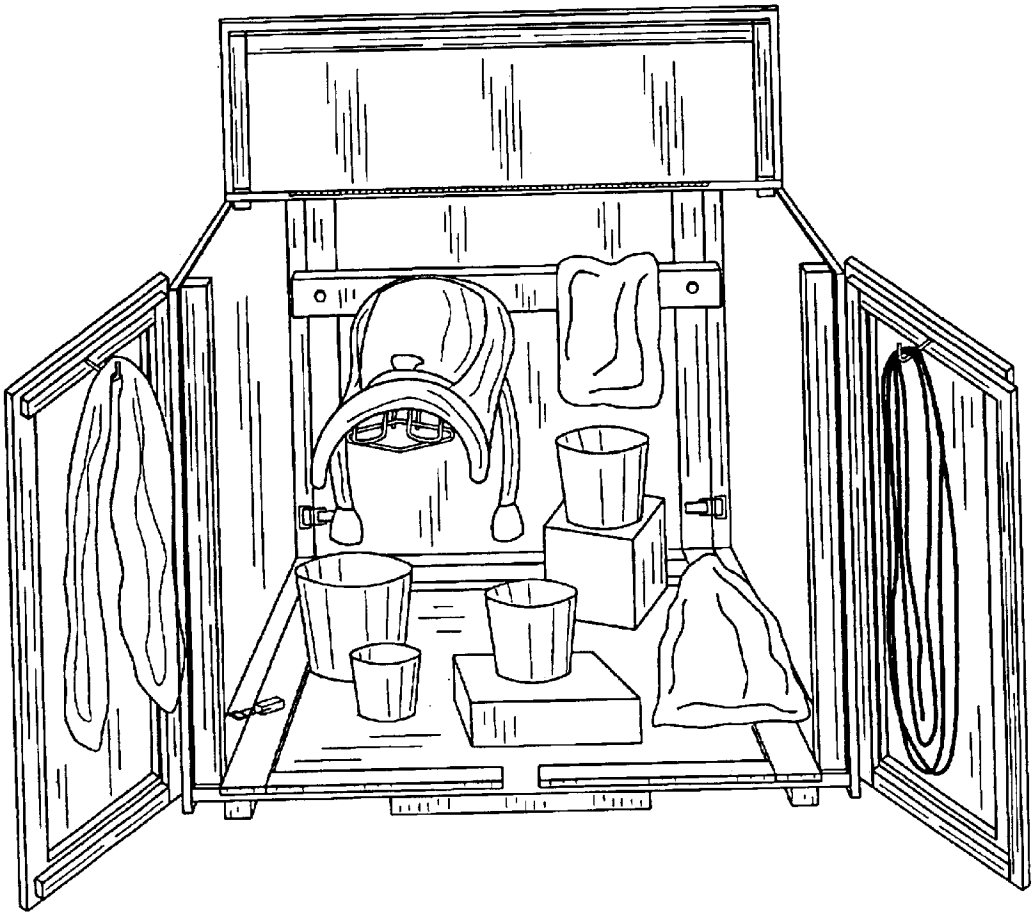
FIG. 18 is a perspective of the fully assembled tack box of FIG. 1, taken from in front, with the door of the left-side wall, the door of the right-side wall and the hinged lid all in open positions and said tack box loaded with a full complement of gear.

Operation:

In operation, one uses the tack box to store and protect saddle(s), bridle(s), various grooming implements and other tack associated with equestrian activities (FIG. 18). Hooks or other holding devices may be mounted on the inner walls in order to provide for storage the various grooming implements. The tack box can be completely closed up (FIG. 17) and locked, so that all of the gear can be protected from dust and dirt, rodents and unauthorized borrowing or theft.

Figure 14:
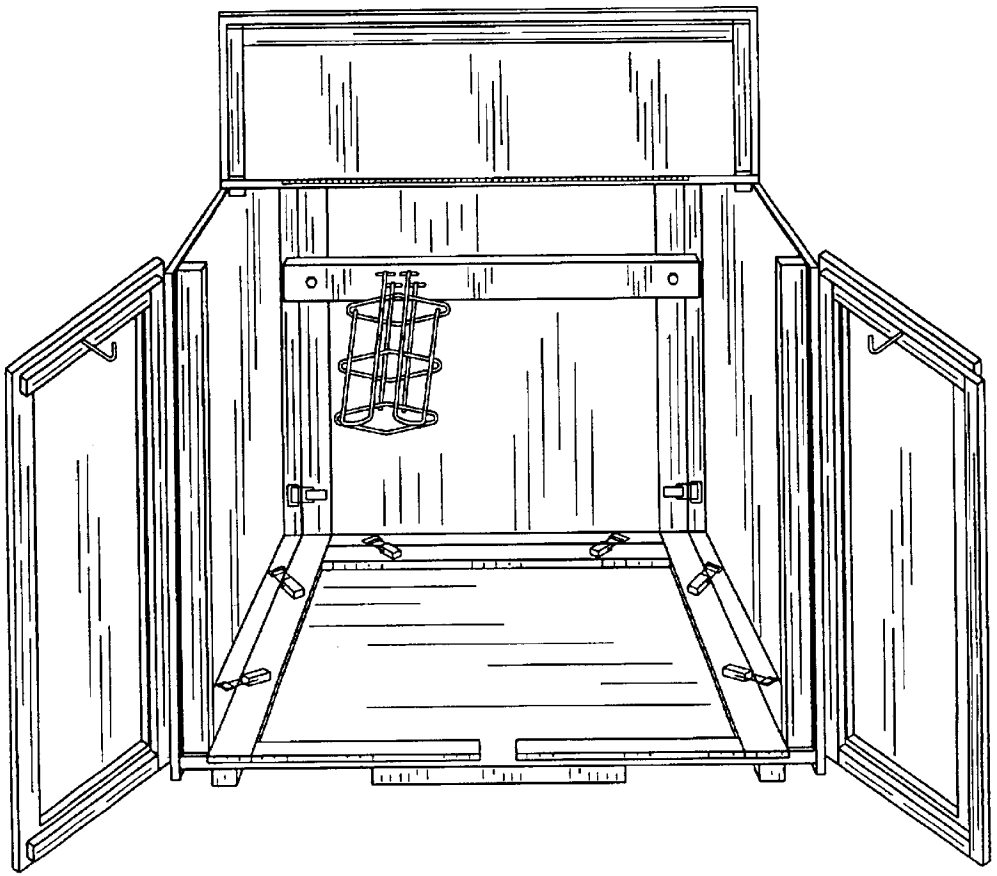
FIG. 14 is a perspective of the fully-assembled tack box of FIG. 1, from in front, with the base, the left-side wall with door attached, the right-side wall with door attached, the rear wall with brace attached, the saddle rack, and the hinged lid (in the open position).
Figure 15:
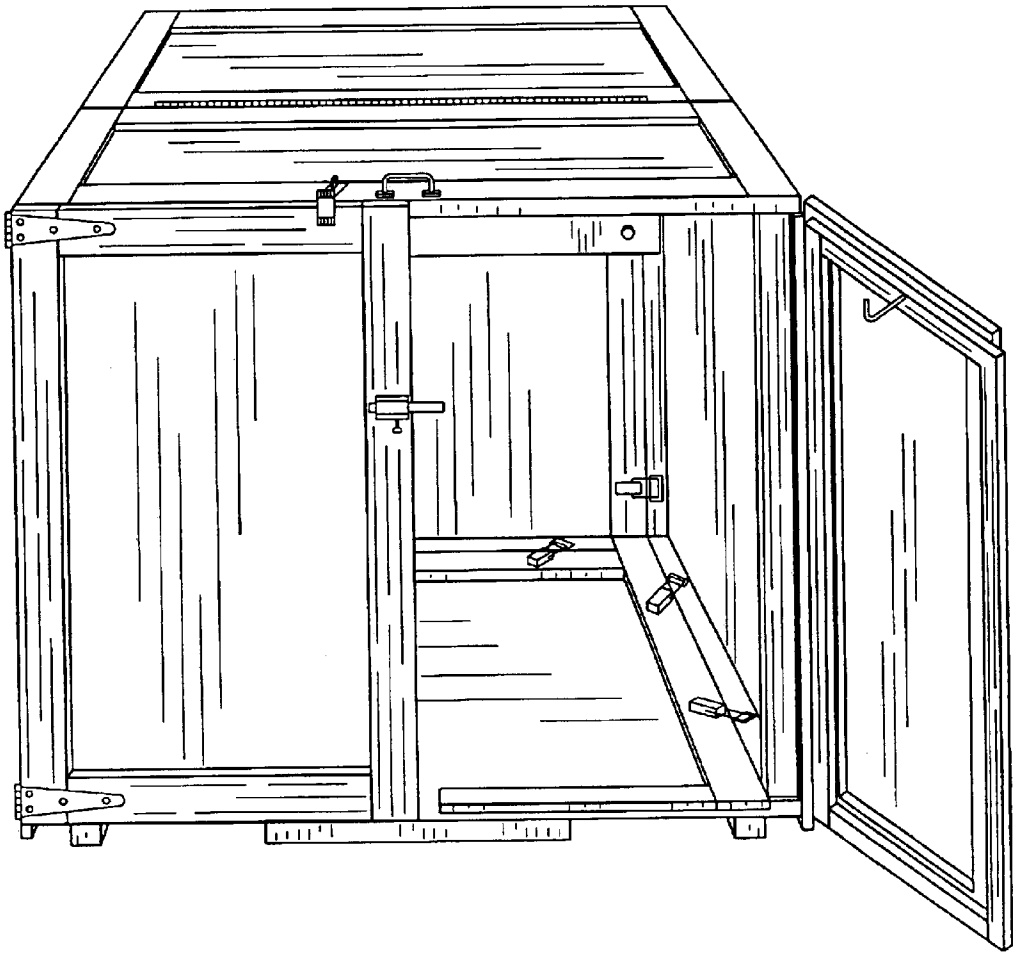
FIG. 15 is a perspective of the fully assembled tack box of FIG. 1, from in front, with the door of the right-side wall in the open position and the hinged lid in the closed position.
Figure 16:
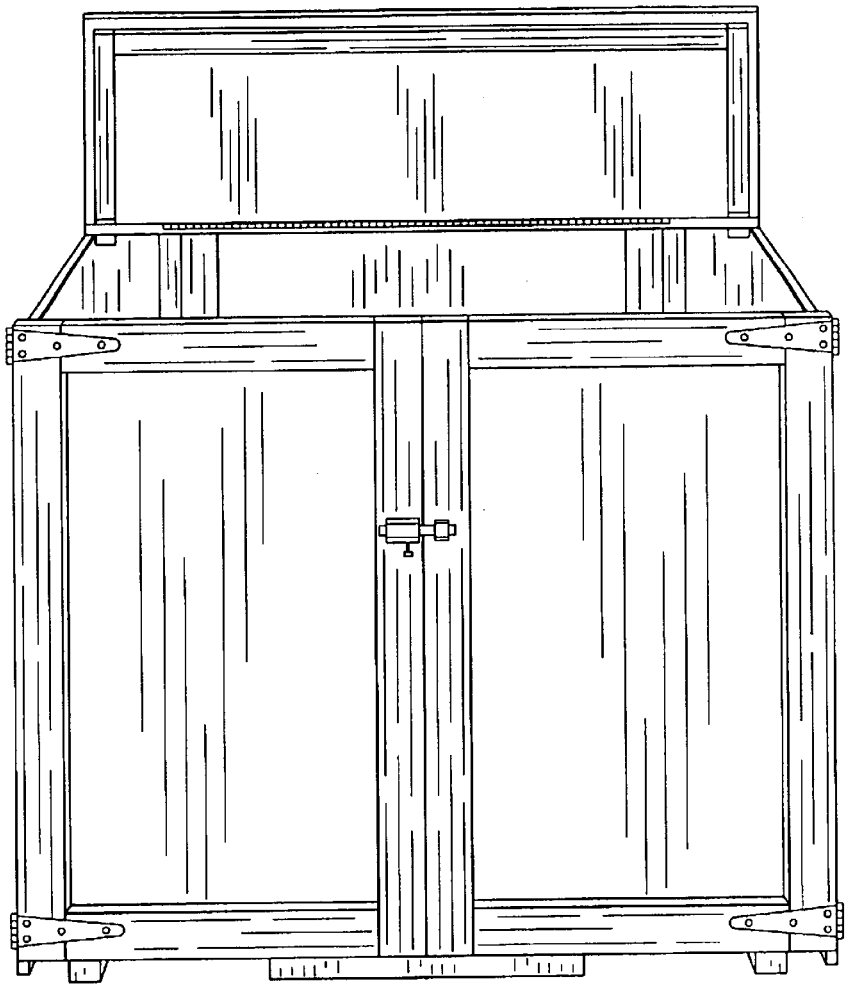
FIG. 16 is a perspective of the fully assembled tack box of FIG. 1, from in front, with the door of the left-side wall and the door of the right-side wall both in closed positions and the hinged lid in the open position.

Two doors at the front of the box and an upward hinging lid can be opened simultaneously to allow maximum access to the interior of the box, which facilitates storage and retrieval of heavy and awkward objects, like a Western-style saddle (FIG. 14). Also, one or both of the doors or the hinged lid can be opened separately (FIGS. 15 and 16) to access only the tack stored in certain areas of the box. Such limited, easy access would be useful, for example, at those times when only one activity, like grooming, is undertaken.

Finally, the tack box can be broken down, without any need for any tools, into five manageable pieces (FIG. 1), plus the removable saddle rack. Each of the two doors fold flush against the outer side of the side wall to which it is attached (FIG. 1). The five major pieces can be stacked on top or against each other for convenient and compact storage when not in use. And the pieces can be transported individually or together in most standard-sized sport utility vehicles and cars.

Assembly of the box requires no tools, is very simple and straightforward and takes only a few minutes:

a. The base is first placed flat on the ground with the raised frame on top. The bottom part of the rear wall is placed into its slot at the rear of the base, and then it is secured to the base by two metal draw latches already attached.
b. The left-side wall (with door attached) is placed into its slot along the top of the left edge of the base and against the side of the rear wall. The left-side wall is then fastened to the base by two metal draw latches and to the rear wall by another two metal draw latches.
c. The right-side wall (with door attached) is placed and secured to the base and the rear wall in the same manner as the left-side wall.
d. Finally, the hinged lid is placed on top of the box and may be secured by latches and locks from the outside.

What I claim is:

1. A portable knockdown tack box, comprising:

a base;

a left-side wall attached to the base with a first removable coupler;

a right-side wall attached to the base with a second removable coupler;

a rear wall attached to the base, right-side wall, and left side wall with a third removable coupler, fourth removable coupler, and fifth removable coupler respectively;

a lid, comprising a first section, a second section hingeably attached to the first section, the first section attached to the left-side wall, right-side wall, and rear wall with a sixth removable coupler, seventh removable coupler, and eighth removable coupler respectively; and a door hingeably attached to one of the group consisting of the right-side wall and the left-side wall wherein the upper edge of the door is adjacent to the second section of the lid.

2. The portable knockdown tack box of claim 1 wherein the rear wall further comprises a support brace to support a removable saddle rack further comprising:

a removable saddle rack adapted to be mounted on the support brace.

3. The portable knockdown tack box of claim 1 wherein at least one of the group consisting of the first removable coupler, the second removable coupler, the third removable coupler, the fourth removable coupler, fifth removable coupler, the sixth removable coupler, the seventh removable coupler, and the eighth removable coupler.

4. The portable knockdown tack box of claim 1 wherein the first removable coupler, the second removable coupler, the third removable coupler, the fourth removable coupler, fifth removable coupler, the sixth removable coupler, the seventh removable coupler, and the eighth removable coupler comprise a striker and a latch.

5. The portable knockdown tack box of claim 1 wherein the door is hingeably attached to the right-side wall, further comprising a second door hingeably attached to the left-side wall wherein the upper edge of the second door is adjacent to the second section of the lid.

6. The portable knockdown tack box of claim 1 wherein the base further comprises a raised frame and the first removable coupler and second removable coupler are attached to the raised frame.

7. The portable knockdown tack box of claim 1 wherein the first section of the lid and second section of the lid are attached by a piano hinge.

8. The portable knockdown tack box of claim 1 wherein the door and second section of the lid are suitably adapted to be simultaneously open to allow maximum access to the tack box.

9. The portable knockdown tack box of claim 1 wherein the base has four sides, the right-side wall, left-side wall, and rear wall are attached to the base at a perpendicular angle, and the lid is attached to the left-side wall, right-side wall and rear wall at a perpendicular angle.

10. A portable knockdown tack box, comprising:

a base with a raised frame;

a left-side wall perpendicularly attached to the raised frame with a first pair of removable couplers a right-side wall perpendicularly attached to the raised frame with a second pair of removable couplers;

a rear wall perpendicularly attached to the raised frame with a third pair of removable couplers, perpendicularly attached to the ride side wall with a fourth pair of removable couplers, and perpendicularly attached to the left side wall with a fifth pair of removable couplers, the rear wall further comprising a support brace;

a removable saddle rack adapted to rest on the support brace;

a lid, comprising a first section, a second section attached via a piano hinge to the first section, the first section perpendicularly attached to the left-side wall with an sixth pair of removable couplers right-side wall, and rear wall with a seventh pair of removable couplers and the rear wall with an eight pair of removeable couplers.

a first door hingeably attached to the right-side wall wherein the upper edge of the first door is adjacent to the second section of the lid; and a second door hingeably attached to the right-side wall wherein the upper edge of the second door is adjacent to the second section of the lid.

11. The portable knockdown tack box of claim 10 wherein the first pair of removable couplers, the second pair of removable couplers, the third pair of removable couplers, the fourth pair of removable couplers, fifth pair of removable couplers, the sixth pair of removable couplers, the seventh pair of removable couplers, and the eighth pair of removable couplers comprise a striker and a latch.

12. The portable knockdown tack box of claim 10 wherein the first door, second door, and second section of the lid are suitably adapted to open simultaneously and allow maximum access.

13. The portable knockdown tack box of claim 10 wherein the base has four sides, the right-side wall, left-side wail, and rear wall are attached to the base at a perpendicular angle, and the lid is attached to the left-side wall, right-side wall and rear wall at a perpendicular angle.

14. The portable knockdown tack box of claim 10 wherein the raised frame abuts the edges of the base.

* * * * *